US007706562B2

(12) United States Patent
Ohara

(10) Patent No.: US 7,706,562 B2
(45) Date of Patent: Apr. 27, 2010

(54) CORRUGATED DAMPER FOR SPEAKER

(76) Inventor: Hiroshi Ohara, No. 70, Lane 533, Chong-Fong Road, U-Lin Village, Long-Tan County, Taou-Yuan Hsien (TW)

( * ) Notice: Subject to any disclaimer, the term of this patent is extended or adjusted under 35 U.S.C. 154(b) by 1091 days.

(21) Appl. No.: 11/325,436

(22) Filed: Jan. 5, 2006

(65) Prior Publication Data

US 2007/0154058 A1 Jul. 5, 2007

(51) Int. Cl.

| | |
|---|---|
| ***H04R 1/00*** | (2006.01) |
| ***H04R 9/06*** | (2006.01) |
| ***H04R 11/02*** | (2006.01) |

(52) U.S. Cl. ..... 381/413; 381/398

(58) Field of Classification Search ..... 381/397, 381/398, 400, 404, 411–413, 433; 181/171, 181/172

See application file for complete search history.

(56) References Cited

U.S. PATENT DOCUMENTS

2003/0089549 A1 * 5/2003 Chan ..... 181/171

* cited by examiner

*Primary Examiner*—Tuan D Nguyen
(74) *Attorney, Agent, or Firm*—Birch, Stewart, Kolasch & Birch, LLP

(57) ABSTRACT

A corrugated damper for a speaker has a plurality of alternating concentric peaks and valleys formed on a surface thereof and a plurality of ribs installed on the valleys in such a way that both ends of the ribs are connected between their respective two adjacent peaks, thereby enhancing strength of the damper while keeping its basic elasticity, and preventing from deformation or breakage of the, damper due to long-term uneven action forces.

9 Claims, 7 Drawing Sheets

CORRUGATED DAMPER FOR SPEAKER

BACKGROUND OF THE INVENTION

1. Field of the Invention

The present invention relates to a suspension element, which is used in a speaker (or so-called loudspeaker).

2. The Prior Arts

FIG. 7 illustrates a configuration of a known dynamic speaker, comprising a power system, a vibrating diaphragm and a suspension system. The power system further comprises a magnet, a pole piece, a top iron, a gap and a voice coil 3. The vibrating diaphragm 2 is a cone paper or hemispheric voice cavity for vibrating or moving air. The suspension system consists of a damper 1 and an edge-suspension member used for controlling movement direction of the vibrating diaphragm 2.

The working principle of speaker is that when the voice coil 3 is loaded by AC current, the current-carrying voice coil 3 in a magnetic field of the magnet experiences a magnetic force and moves up and down in the gap, so that the cone paper attached to the voice coil 3 moves air to generate sounds.

The damper 1 is an important element of the suspension system in a speaker, which is used for supporting the voice coil 3. The vibrating diaphragm 2 is attached to the voice coil 3 and will move air to generate desired vibrations. This function is similar to a buffer spring included in an automobile suspension system. Thus, a good damper depends on whether it has sufficient elasticity and strength or not.

With reference to FIG. 6, which illustrates a configuration of a damper in accordance with a prior art, the damper forms a plurality of alternating concentric peaks 11 and valleys 12 on a surface thereof, thereby presenting a corrugated surface (also see FIG. 7). A central hole of the damper 1 is assembled to the voice coil 3, and an outer periphery of the damper 1 is suspended on a housing of the speaker. In view of the concentric structure of the damper 1, it has sufficient strength in radial direction, but its flexible strength in circumferential direction is insufficient. Because the damper is under the action of uneven forces that maybe result from mechanical factors or the speaker being placed at an unstable place, it will give rise to a deformation after operated long period of time, thereby affecting its performance. Accordingly, it is desired to provide an improved damper for a speaker that can improve the aforementioned defects.

SUMMARY OF THE INVENTION

A primary objective of the present invention is to provide a corrugated damper for a speaker, which has a larger strength and is able to prevent from deformation due to long-term uneven action forces.

According to a first aspect of the present invention, a plurality of ribs are installed on all valleys of the damper, and both ends of the ribs are connected between their respective two adjacent peaks of the damper, so that the damper has a higher strength in circumferential direction.

According to a second aspect of the present invention, a plurality of ribs are installed on partial valleys of the damper, and both ends of the ribs are connected between their respective two adjacent peaks of the damper.

According to a third aspect of the present invention, a plurality of ribs is integrally formed on the valleys of the damper in molding process of the damper.

According to a fourth aspect of the present invention, a plurality of ribs installed on the valleys of the damper is arranged in radial or spiral way.

Compared with the traditional corrugated dampers having a plurality of alternating concentric peaks and valleys, the damper in accordance with the present invention comprises a plurality of ribs appropriately installed on the valleys of the damper, thereby enhancing its strength while keeping its basic, elasticity, and obtaining a better performance and longer service lifetime.

The present invention will be apparent to those skilled in the art by reading the following detailed description of a preferred embodiment thereof, with reference to the attached drawings, in which:

DETAILED DESCRIPTION OF THE PREFERRED EMBODIMENT

Figure 1:
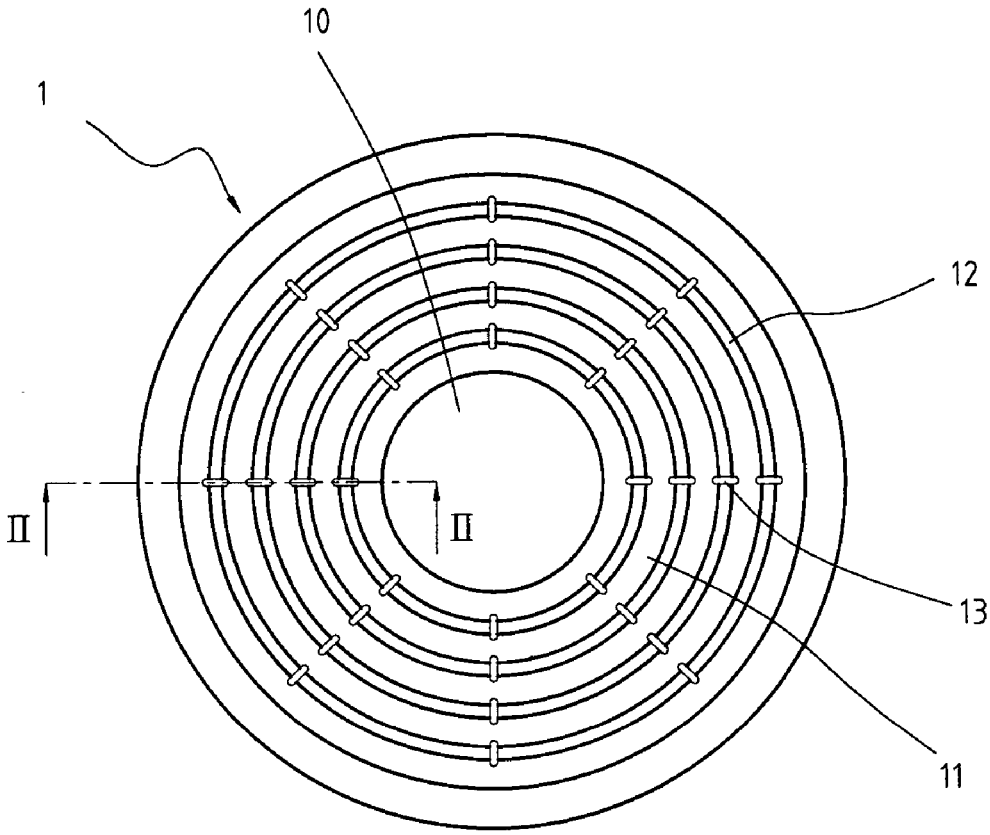
FIG. 1 is a plane view of a damper for a speaker in accordance with a first preferred embodiment of the present invention.
Figure 2:
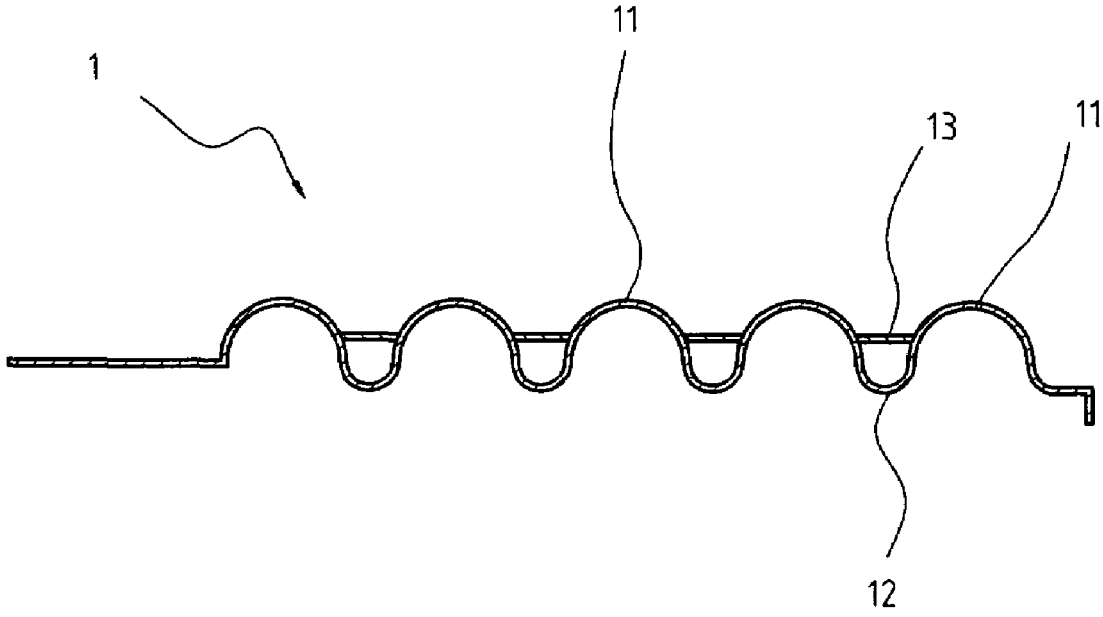
FIG. 2 is a cross-sectional view taken along line II-II of FIG. 1.

With reference to FIGS. 1 and 2, a corrugated damper 1 according to the present invention has a structure including a plurality of alternating concentric peaks 11 and valleys 12 formed on a surface thereof and a central hole 10. A plurality of ribs 13 are installed at the valleys 12 in such a way that both ends of the ribs 13 are connected between their respective two adjacent peaks 11. Accordingly, each of the concentric valleys 12 is divided into a plurality of segments, so that the damper 1 has higher strength in radial and circumferential directions but not losing its elasticity.

According to one preferred embodiment of the present invention, the ribs 13 can be integrally formed on the valleys 12 in molding process of the damper 1. In other word, a mold is provided with a pre-shaped cavities for forming the concentric peaks 11 and valleys 12 and ribs 13 of the damper 1, so that in the molding process of the damper 1, the ribs 13 are formed on the valleys 12 and connected between their respective two adjacent peaks 11 while the peaks 11 and valleys 12 are formed by a hot press way.

Figure 3:
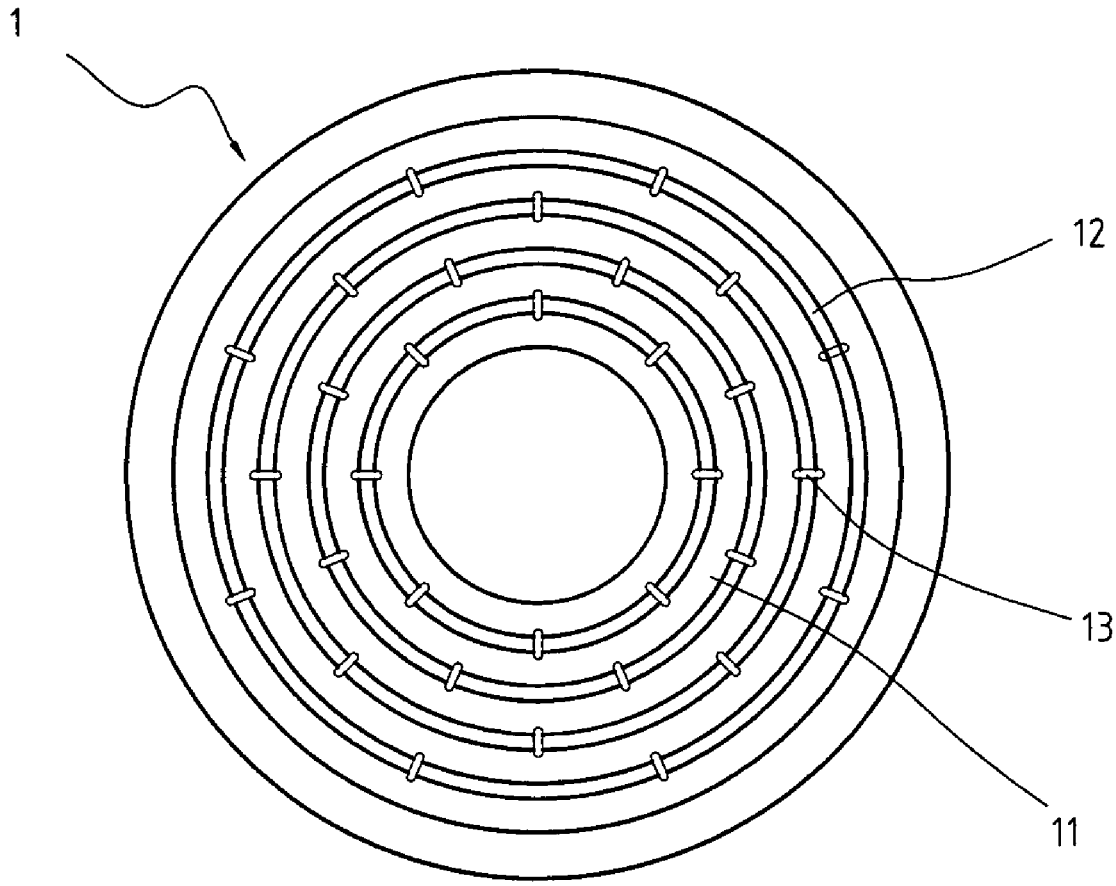
FIG. 3 is a plane view of a damper in accordance with a second embodiment of the present invention.
Figure 4:
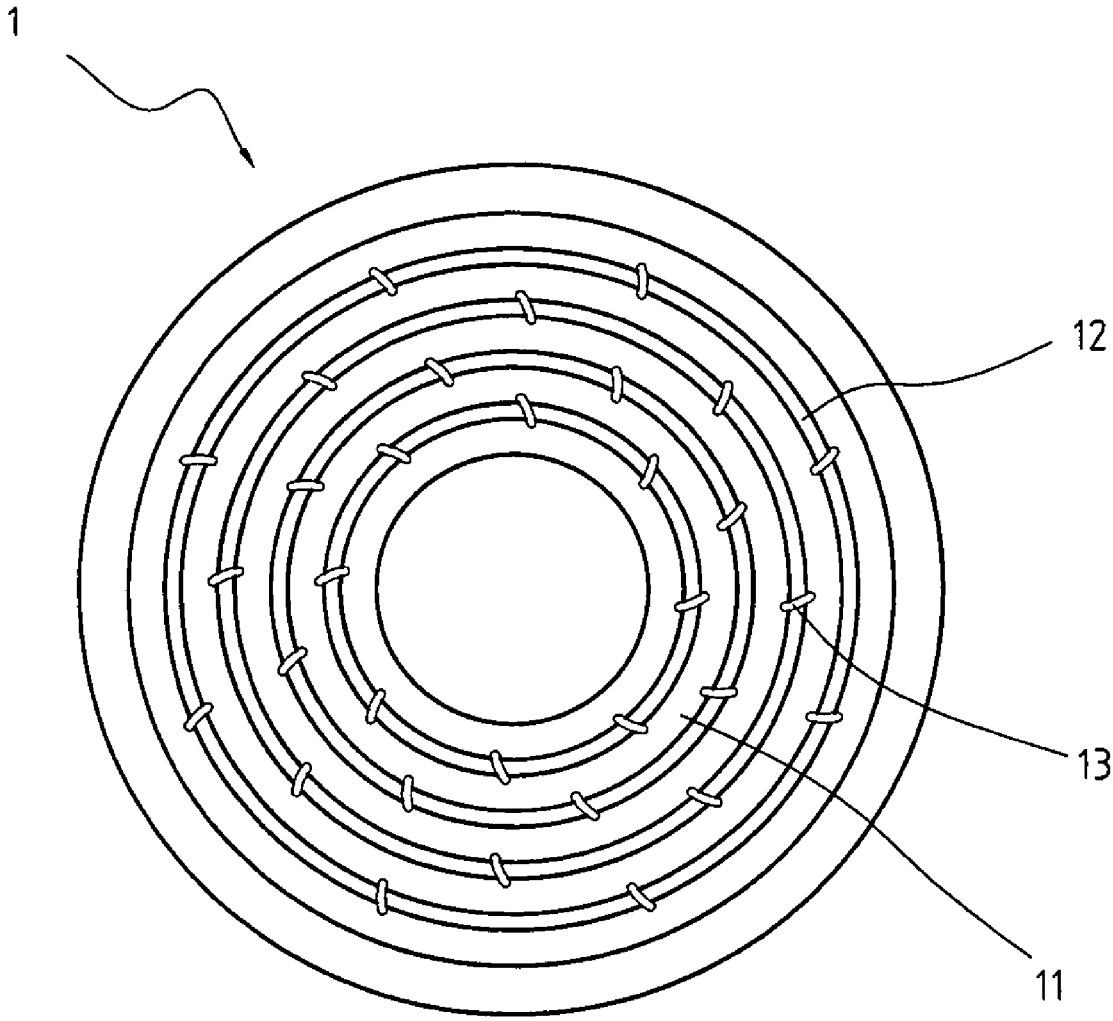
FIG. 4 is a plane view of a damper in accordance with a third preferred embodiment of the present invention.

Furthermore, the ribs 13 may be positioned on the valleys 12 of the damper 1 and connected between their respective two adjacent peaks 11 in various arrangements. Referring to FIG. 1, a plurality of ribs 13 are positioned on the valleys 12 of the surface of the damper 1 in radial arrangement. Referring to FIG. 3, a plurality of ribs 13 on adjacent valleys 12 are interposed with each other and in radial arrangement. Referring to FIG. 4, a plurality of ribs 13 are in arc shape, and positioned on the valleys 12 of the surface of the damper 1 in an inclined angle with respect to radial direction, so that they are arranged in a spiral way.

Figure 5:
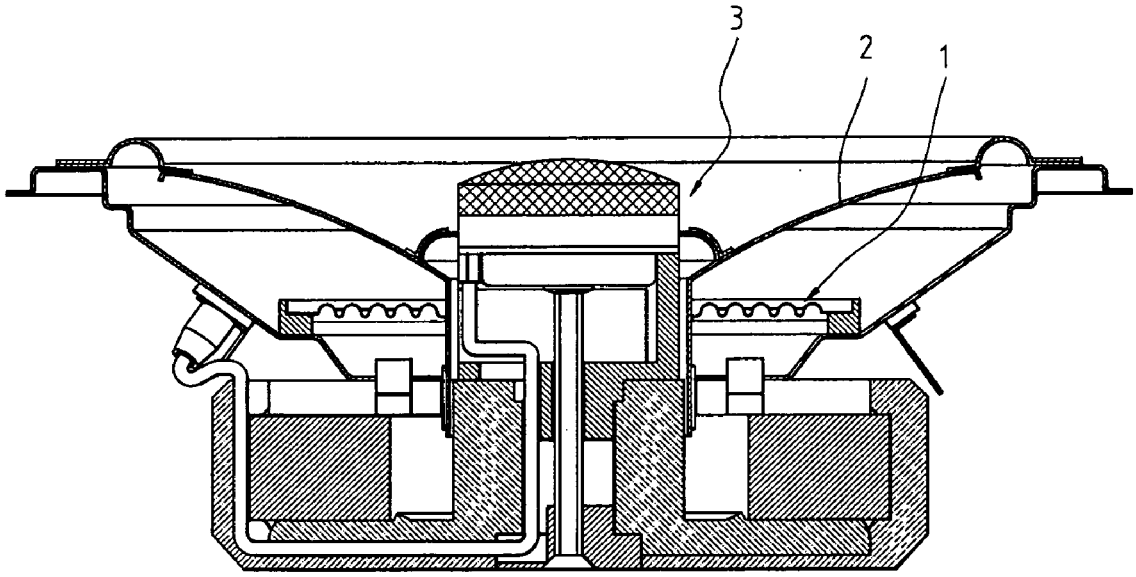
FIG. 5 illustrates the damper of the present invention being assembled in speaker.
Figure 6:
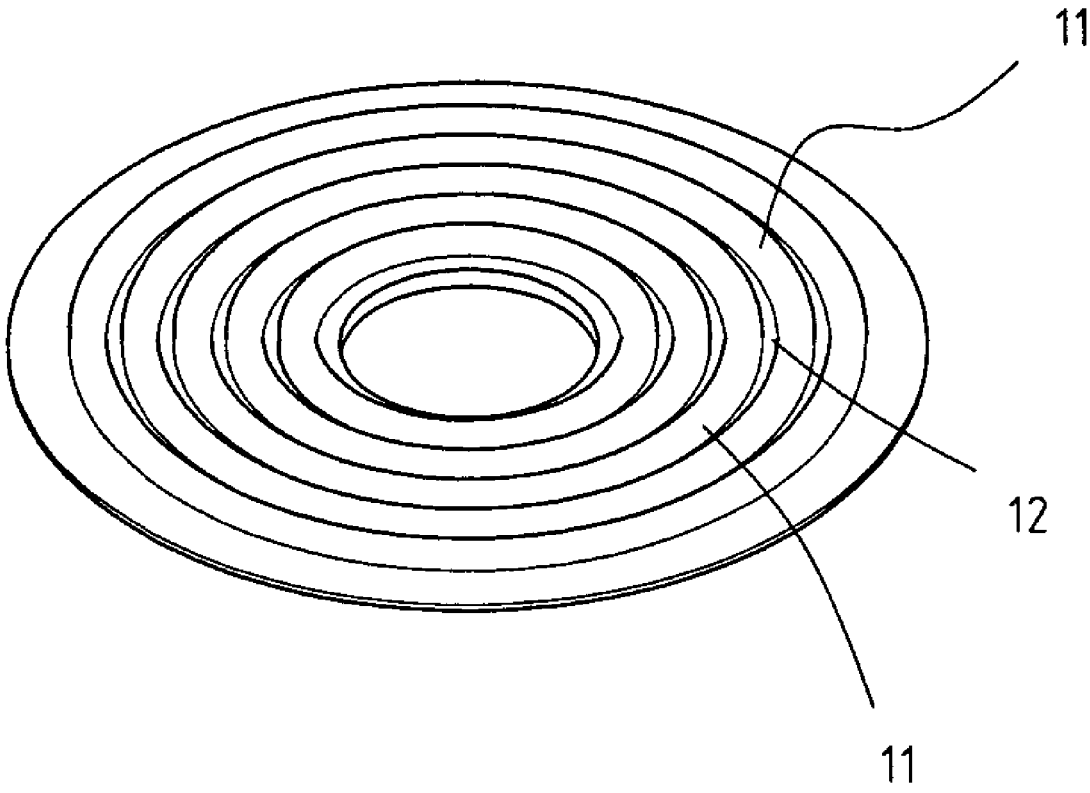
FIG. 6 (PRIOR ART)
FIG. 6 illustrates a damper in accordance with a prior art.
Figure 7:
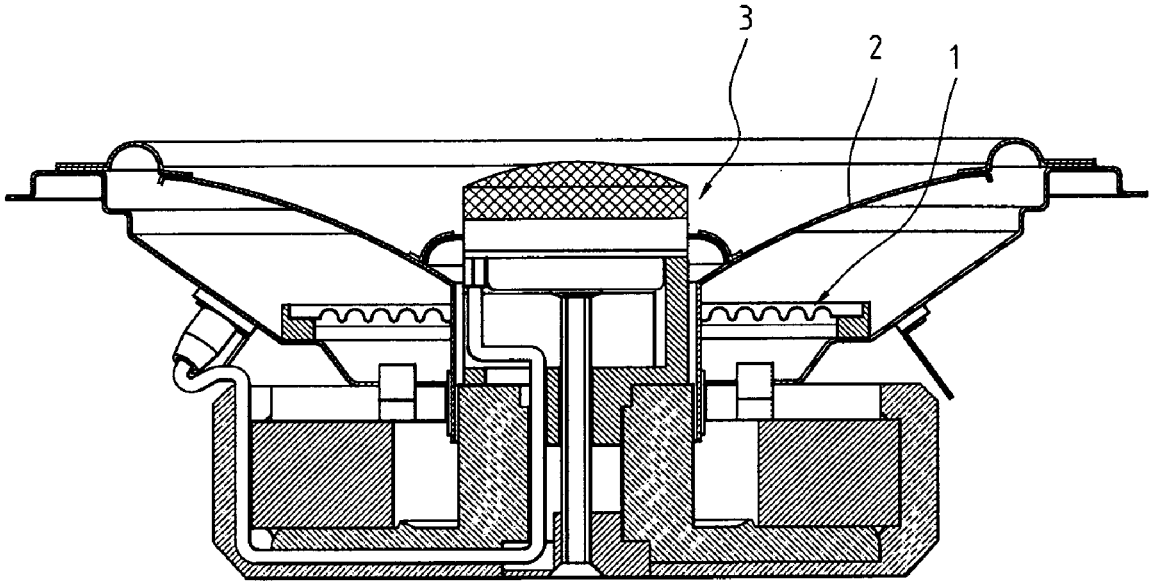
FIG. 7 (PRIOR ART)
FIG. 7 illustrates the conventional damper being assembled in a speaker.

Referring to FIG. 5, which illustrates a damper 1 in accordance with the present invention being assembled to a speaker, the central hole 10 of the damper 1 is assembled with a voice coil 3, and a periphery of the voice coil 3 is fastened to a vibrating diaphragm 2.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A corrugated damper for a speaker, having a plurality of alternating concentric peaks and valleys formed on a surface thereof and a central hole, wherein the improvement comprises:

a plurality of ribs installed on the valleys of a surface of the damper in such a way that both ends of the ribs are connected between their respective two adjacent peaks, wherein each of the concentric valleys is divided into a plurality of segments, so that the damper has higher strength in radial and circumferential directions but not losing its elasticity.

2. The corrugated damper as claimed in claim 1, wherein the ribs on the valleys of the surface of the damper are in radial arrangement.

3. The corrugated damper as claimed in claim 1, wherein the ribs on adjacent valleys of the surface of the damper are interposed with each other and in radial arrangement.

4. The corrugated damper as claimed in claim 1, wherein the ribs on the valleys of the surface of the damper are in spiral arrangement.

5. The corrugated damper as claimed in claim 1, wherein the ribs on the valleys of the surface of the damper are integrally formed thereon in molding process of the damper.

6. The corrugated damper as claimed in claim 2, wherein the ribs on the valleys of the surface of the damper are integrally formed thereon in molding process of the damper.

7. The corrugated damper as claimed in claim 3, wherein the ribs on the valleys of the surface of the damper are integrally formed thereon in molding process of the damper.

8. The corrugated damper as claimed in claim 4, wherein the ribs on the valleys of the surface of the damper are integrally formed thereon in molding process of the damper.

9. The corrugated damper as claimed in claim 1, wherein each of said plurality of ribs connects only two adjacent concentric peaks and is independent of other ribs.

* * * * *